United States Patent [19]

Eppinger et al.

[11] 4,369,718

[45] Jan. 25, 1983

[54] SHUT-OFF SYSTEM FOR FLUE GAS CONDUITS OR AIR INTAKE CONDUITS IN OIL AND GAS FIRE SYSTEMS

[76] Inventors: Otto Eppinger; Mariao Eppinger, both of Akazienweg 2, D-8898 Schrobenhausen 1, Fed. Rep. of Germany

[21] Appl. No.: 185,098

[22] Filed: Sep. 8, 1980

[30] Foreign Application Priority Data

Jul. 9, 1979 [DE] Fed. Rep. of Germany ..... 2936296

[51] Int. Cl.[3] ..... F23L 1/00

[52] U.S. Cl. ..... 110/163; 110/175 A; 126/285 R; 126/290; 126/292

[58] Field of Search ..... 110/163, 175 A; 236/45; 126/285 R, 290, 292

[56] References Cited

U.S. PATENT DOCUMENTS

| | | | |
|---|---|---|---|
| 802,110 | 10/1906 | Peterman | 110/175 A |
| 2,111,611 | 3/1938 | Brenner | 137/152 |
| 2,557,210 | 6/1951 | Viola et al. | 110/163 X |
| 2,620,984 | 12/1952 | Larsen | 236/45 |
| 3,123,028 | 3/1964 | Bodeker | 110/163 |
| 3,987,785 | 10/1976 | Long | 110/163 X |

FOREIGN PATENT DOCUMENTS

| | | |
|---|---|---|
| 1971132 | 6/1967 | Fed. Rep. of Germany . |
| 1992176 | 8/1968 | Fed. Rep. of Germany . |

*Primary Examiner*—Edward G. Favors

*Attorney, Agent, or Firm*—Neuman, Williams, Anderson & Olson

[57] ABSTRACT

An energy-saving closure system is provided for use in preventing needless energy loss. The system employs a pivotal closure adapted to alternately move between the fully open and fully closed portion in a conduit for conveying gases relative to a combustion zone. The closure requires pressure diffentials only for being urged into the open and closed positions such as normally occur in the heating cycle. No energy-consuming, auxiliary apparatus is needed.

7 Claims, 2 Drawing Figures

SHUT-OFF SYSTEM FOR FLUE GAS CONDUITS OR AIR INTAKE CONDUITS IN OIL AND GAS FIRE SYSTEMS

The invention relates to a shut-off system for installation in the exhaust gas or air inlet conduit of oil and gas fire and furnace systems including a flow-through housing with two different sized openings and, incorporated in said flow-through housing, a shut-off system which is pivotal between a shut-off position and an open position.

The invention will be explained with the aid of an example of embodiment illustrated in the Figures, wherein.

Figure 1:
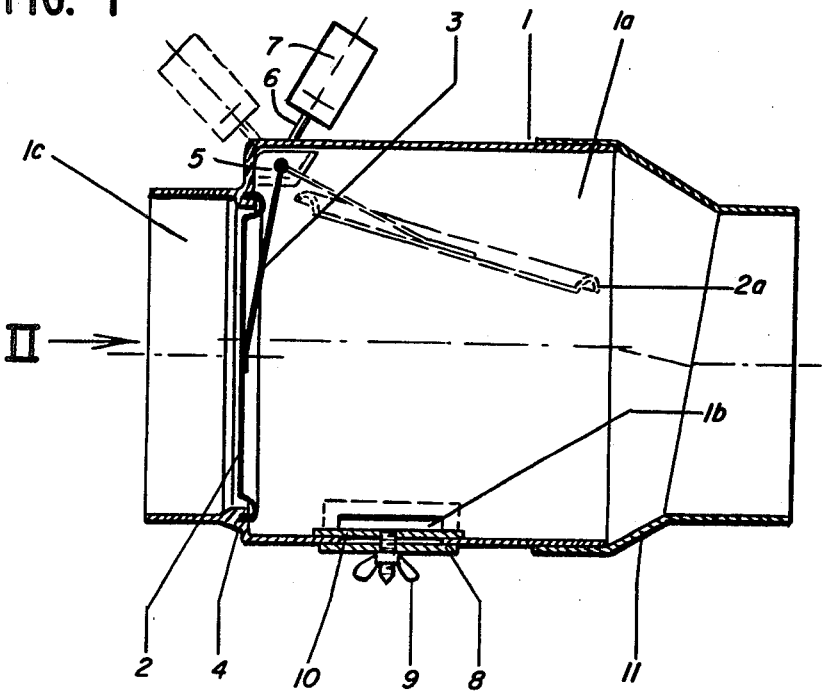
FIG. 1 is a vertical section through the shut-off system.
Figure 2:
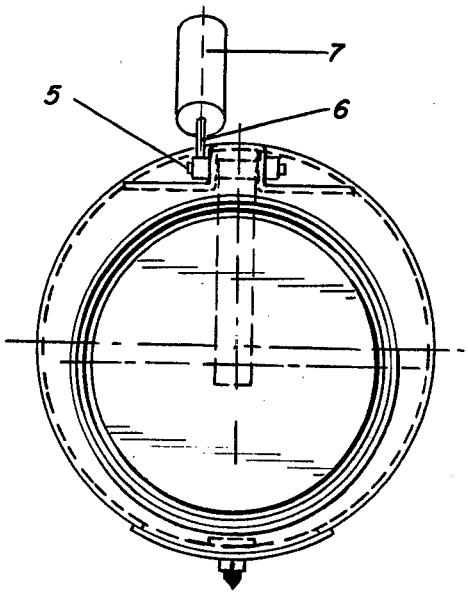
FIG. 2 is a view in the arrow direction II.

This shut-off system differs from hitherto known shut-off flaps in that the shut-off system moves into the open position up to a certain position firstly with an almost constant low air pressure which is produced by the burner fan. From this certain position onwards, the more the shut-off system opens the smaller the air pressure necessary. The pressure difference is placed by the weight (7) via the lever (6), which is mounted outside the housing (1). The pivoting of the shut-off system from the open position to the shut-off position is effected by the burner stopping and the partial weight of the cover (2). The complete closure is effected by the weight (7) via the lever (6). The shut-off system according to the invention with the lever (6) and weight (7) has the advantage compared with conventionally electrically controlled shut-off flaps or pivot flaps that up to a certain opening low energy is necessary for a short time. The main energy requirement is provided by the weight (7), which is not the case with shut-off flaps controlled by a motor. In the latter, the full energy consumption is necessary for the whole time in which the burner fan operates. Due to the seal (4) and cover (2) this shut-off system provides a completely tight shutting-off, which is also not the case with known systems so that in the latter when the burner is stationary a high percentage of the energy is lost.

With the invention, in the interior of the housing (1) or (1*a*) over a long period of time a large amount of combustion residues can form without impairing the shutting-off, which is not the case with known conventional shut-off flaps with which complete shutting-off is no longer achieved and with partial closure there is the danger of complete energy loss by the rapid air passage. This shut-off system can also be opened with a magnet via a lever arm, servo motor or hydraulically via the burner control and closed with a coil or tension spring, similar to the conventional shut-off flaps. The stop for the open shut-off system is provided by the cover (2) in the housing interior (1*a*). The exit cross-section in the open position of the shut-off system in the housing (1*a*) is greater than the inlet cross-section (1*c*) to keep the gas and air flow resistance as low as possible. This flue gas or air shut-off system can comprise at the lower side in the housing (1) a cleaning opening (1*b*) with closure member (8), wingnut (9) and support with fitted threaded bolt (10).

When used as flue gas shut-off system there are various installation possibilities. One possibility is: On subsequent installation an optimum location can be obtained in the flue gas conduit if the reducing section (11) is also used. Another possibility is:

This shut-off system is installed directly at the flue. This saves the reducing section (11), which with new systems can be done without difficulty. A shut-off system can be incorporated into the flue conduit without great expenditure and special knowledge.

The use of a shut-off system in the air inlet conduit before the burner fan differs depending on the burner design. The shut-off system differs from conventional air flaps or pivot flaps in that the shut-off system moves into the open position up to a certain position firstly with a minimum partial vacuum produced by the suction of the burner fan. From the certain position onwards, the more the shut-off system opens the smaller the amount of reduced pressure required in the housing interior (1*a*). The greater part of the energy requirement for the reduced pressure is replaced by the weight (7) via the lever (6). This shut-off system can also be opened with a magnet via a lever arm, servo motor or hydraulically via the burner control and close with a coil or tension spring. Otherwise, the shut-off system for air intake conduits and exhaust conduits differs only in the material and material thickness, and the opening (1*c*) is somewhat shortened and the small opening of the reducing section (11) is adapted for connection to the particular fan inlet or suction point. The cleaning opening with the closure disc (8), winged nut (9) and support with bolt (10) is not necessary. Another advantage is that a shut-off system with correspondingly modified reducing section (11) can be used for several makes and models.

We claim:

1. A closure system for regulating the flow of exhaust gases or feed air of a fuel combustion system and preventing energy losses when combustion is not taking place, comprising a conduit for such gases or air; a rotatable shaft; a closure for controlling gaseous flow in said conduit between two conduit portions and biased normally into the closed position; said closure being supported by and movable with said rotatable shaft between alternate fully closed and fully open positions in said conduit; said conduit portions being of differing cross-sectional area; said closure being positioned between said two portions and arranged to permit gaseous flow from the smaller portion to the larger portion when in the open position; means interconnecting said closure with said rotatable shaft; said closure being responsive to slight pressure differences between said conduit portions tending to open said closure whereby said closure is readily movable about said shaft into the fully open position; counterweight means mounted on an arm connected to said rotatable shaft for urging said shaft in a direction of rotation resulting in biasing said closure into the closed position when said closure is in the closed position and for urging said shaft in a direction of rotation resulting in biasing said closure into the open position when said closure is in the open position; said closure requiring decreasing opening pressure for moving into the fully open position with increasing movement thereof away from the closed position, and being of such weight as to return to its normal closed position in opposition to said counterweight means upon substantial equalization of the pressure in said two conduit portions; and sealing means disposed between said two conduit portions; said closure effecting a substantially gas-tight seal and compressing said sealing means when in the fully closed position.

2. The closure system of claim 1 in which a blower for supplying feed air for combustion creates a partial vacuum in said conduit and the resulting pressure differential between said conduit portions pivots and closure into the fully open position.

3. The closure system of claim 1 in which said counterweight means and arm are adjustably positionable relative to said rotatable shaft whereby the initial gaseous pressure to move said closure may vary.

4. The closure system of claim 1 in which said closure has a stiffening rib formed therein and said sealing means is mounted in said rib.

5. The closure system of claim 1 in which said seal effected by said closure and sealing means is spaced from the outer periphery of the conduit portion in which said closure is disposed whereby foreign matter which may be disposed on the floor of such housing portion is not swept against such sealing means when said closure moves into the fully closed position.

6. The closure system of claim 1 in which said rotatable shaft is journaled in bearings disposed exteriorly of said conduit, whereby foreign matter disposed in gases passing through said conduit cannot contaminate such bearings and affect the movement of said closure about said shaft.

7. The closure system of claim 1 in which said arm and the counterweight means mounted thereon define a moment arm of decreasing force resisting opening of said closure upon closure pivotal movement until said counterweight means are vertically aligned with said shaft whereafter the counterweight means urges said closure into the closed position.

* * * * *